US005791335A

United States Patent [19]

Luciani

[11] Patent Number: 5,791,335

[45] Date of Patent: Aug. 11, 1998

[54] SNOW MELTING APPARATUS

[76] Inventor: Wayne E. Luciani, 6 Lawrence St., Woodbridge, Conn. 06525

[21] Appl. No.: 690,635

[22] Filed: Jul. 30, 1996

[51] Int. Cl.[6] ..... F24H 1/00

[52] U.S. Cl. ..... 126/343.5 R; 37/228

[58] Field of Search ..... 126/343.5 R, 343.5 A; 37/227, 228

[56] References Cited

U.S. PATENT DOCUMENTS

| | | | |
|---|---|---|---|
| 88,693 | 4/1869 | Borgfeldt | 126/343.5 R |
| 840,444 | 1/1907 | Elliot | 126/343.5 R |
| 980,314 | 1/1911 | McGill | 126/343.5 R |
| 1,360,238 | 11/1920 | McGill | 126/343.5 R |
| 1,821,292 | 9/1931 | Chase . | |
| 2,576,829 | 11/1951 | Fiduccia | 126/343.5 R |
| 3,123,922 | 3/1964 | Spinelli . | |
| 3,155,089 | 11/1964 | Hoyt . | |
| 3,455,041 | 7/1969 | Roberts | 37/227 |
| 4,506,656 | 3/1985 | Baasch . | |
| 4,697,572 | 10/1987 | James et al. . | |
| 5,235,762 | 8/1993 | Brady . | |
| 5,638,988 | 6/1997 | Rogers et al. | 222/81 |

FOREIGN PATENT DOCUMENTS

| | | | |
|---|---|---|---|
| 834976 | 3/1952 | Germany | 126/343.5 R |
| 1231105 | 5/1986 | U.S.S.R. | 37/227 |

*Primary Examiner*—Carl D. Price

*Attorney, Agent, or Firm*—Alix, Yale & Ristas, LLP

[57] ABSTRACT

A snow melting apparatus comprises a hopper which forms a lower trough. A pivoting ram/screen assembly prevents large object debris from passing to the trough. A manifold which mounts a plurality of rotating sprinkler heads defines a spray zone for discharging heated water into the centrally disposed snow debris introduced into the hopper. The hydraulic systems of a vehicle are employed to power hydraulic pumps and the ram/screen assembly which also functions as a ram to break up large chunks of snow debris.

20 Claims, 5 Drawing Sheets

SNOW MELTING APPARATUS

BACKGROUND OF THE INVENTION

This invention relates generally to devices which are employed for melting snow. More particularly, the present invention relates to devices which are employed in connection with bulk snow removal for melting snow.

A number of devices have been advanced for addressing the melting of large quantities of snow for snow removal purposes. Such devices typically have a large receptacle for receiving the snow debris and various structures for melting the snow, including water spray devices, grinding devices and heating-type devices which melt the snow.

Various snow melting devices to which the invention relates are set forth by patentee and patent number below:

| Patentee | Patent Number |
|---|---|
| Baasch | 4,506,656 |
| James et al | 4,697,572 |
| Brady | 5,235,762 |

SUMMARY OF THE INVENTION

Briefly stated, the invention in a preferred form is a snow melting apparatus which comprises a hopper which forms an enclosure for receiving the snow. The hopper has a lower trough and an outlet. A circulation path extends from the trough generally around the interior of the enclosure. A furnace is disposed in the circulation path to heat material which traverses the path. A pump is preferably employed to pump the material through the circulation path. A plurality of spaced sprinkler heads communicate with the circulation path to define a water spray zone within the enclosure. A screen is disposed in the enclosure for preventing the passage of objects to the trough. The screen is also pivotally displaceable to break up snow which impacts the screen. Snow dumped in the hopper passes through the screen to the trough wherein a snow/water mixture is pumped to the furnace and heated to substantially produce water which is propelled through the sprinklers into snow retained in the enclosure. The melted snow is drainable through the outlet.

The circulation path is formed by a multi-level manifold. The furnace has a coil-like conduit which is in heat exchange relationship with the mixture which traverses through the circulation path. Hydraulic pumps are preferably operable by the hydraulic system of an associated vehicle. The sprinklers are rotatable. The screen assembly comprises a pair of screen members which are pivotable about a longitudinal axis which extends through the enclosure. The hopper includes a cover comprising a pair of panels which are spring loaded to a closed position and are displaceable to receive snow debris dumped on top of the covers. The screen assembly is also pivotally displaceable by power supplied by a hydraulic system of an associated vehicle.

An object of the invention is to provide a new and improved snow melting apparatus which operates in an efficient and cost effective manner.

Another object of the invention is to provide a new and improved snow melting apparatus which is adapted to be mobile and rapidly transportable.

A further object of the invention is to provide a new and improved snow melting apparatus adaptable for mounting to a truck frame or other heavy duty vehicular frame or inside an existing dump or truck body and is operable by conventional hydraulic systems associated with the vehicle.

A further object of the invention is to provide a new and improved snow melting apparatus which does not require an external water supply and has an efficient construction which effectively prevents damage from foreign objects or solid material which may be present in the snow debris.

Other objects and advantages of the invention will become apparent from the drawings and the specification.

DETAILED DESCRIPTION OF THE PREFERRED EMBODIMENT

Figure 1:
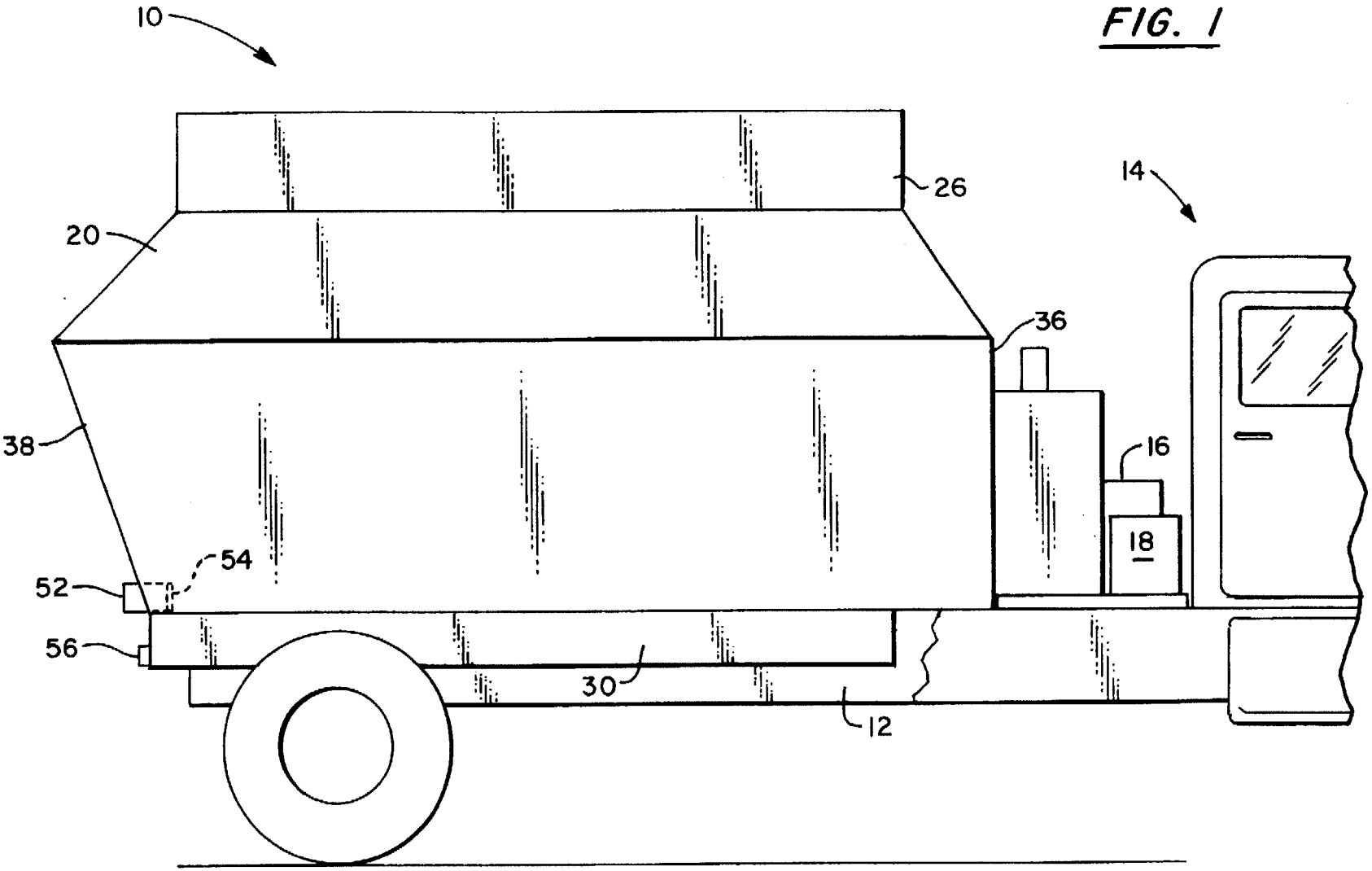
FIG. 1 is a side elevational view of a snow melting apparatus in accordance with the present invention, said apparatus being illustrated in conjunction with a portion of a vehicle, which is partly broken away.
Figure 2:
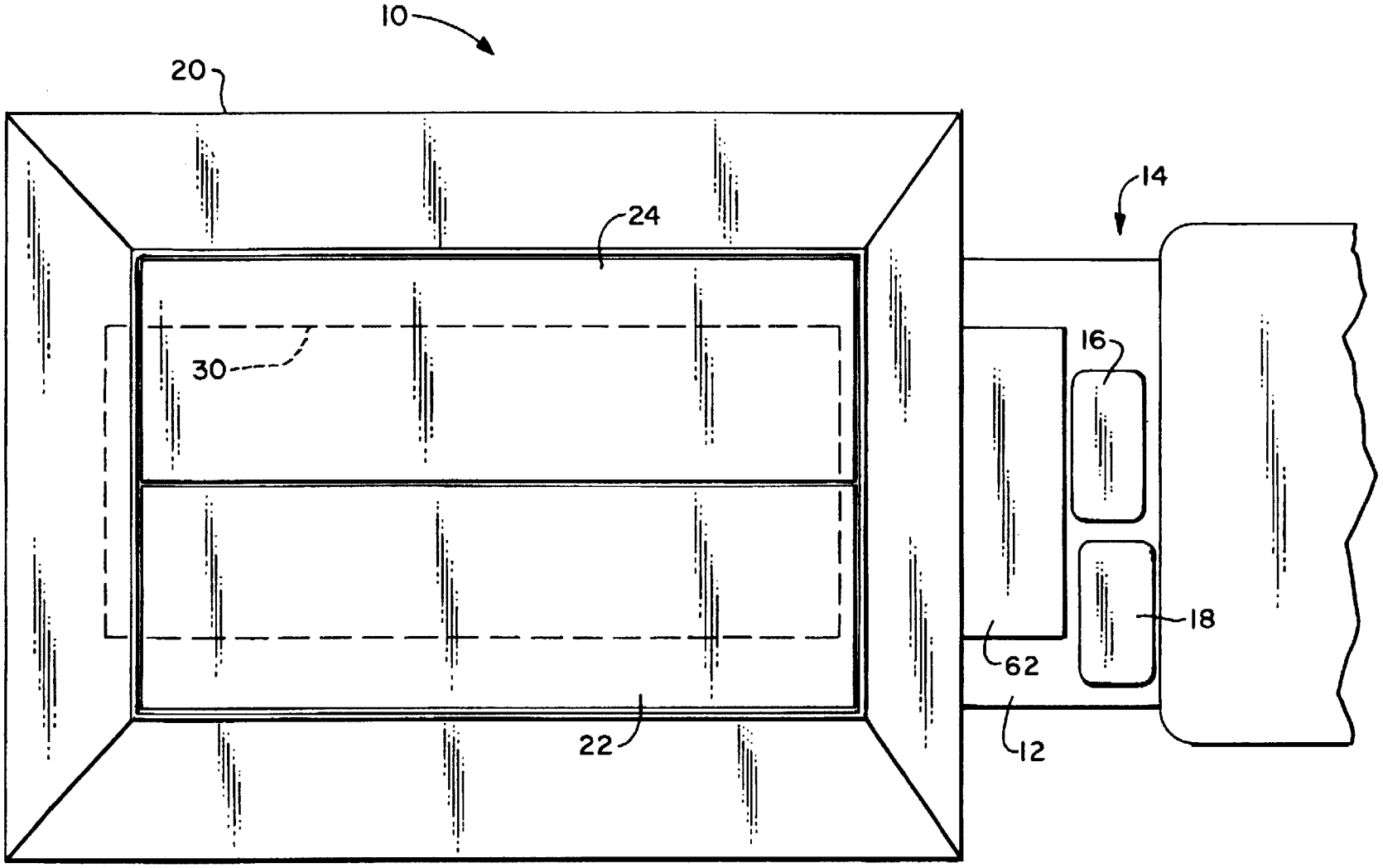
FIG. 2 is a fragmentary top view, partly in phantom, of the snow melting apparatus and vehicle of FIG. 1.

With reference to the drawings wherein like numerals represent like parts throughout the figures, a snow melting apparatus in accordance with the present invention is generally designated by the numeral 10. The snow melting apparatus is particularly adaptable for mounting to the frame 12 of a dump truck or similar heavy-duty vehicle (generally designated by the numeral 14) and for operation with the conventional hydraulic systems (generally designated by the numerals 16 and 18) of the vehicle. The snow melting apparatus 10 functions to receive bulk quantities of snow and to melt the snow to form a water residue which may be selectively drained from the apparatus as required.

The snow melting apparatus 10 comprises an enclosed hopper 20 having a pair of top covers 22 and 24 which are normally closed to form an enclosure. The top covers 22 and 24 as illustrated are generally horizontally oriented in the closed position. Alternately, the top covers may also be oriented at an angle in the closed position. The hopper has a multi-sided configuration with an upper rectangular intake throat 26. The hopper includes opposed pairs of angled side panels 28 which function as a chute for guiding the snow debris toward a rectangular trough 30 at the bottom of the enclosure. The covers 22 and 24 are biased by a pair of spring assemblies 32 and 34 which bias the covers to the closed position but allow the covers to downwardly pivot (in the direction of the FIG. 3 arrows) to allow snow which is dumped on the covers of the hopper to discharge into the hopper.

Figure 3:
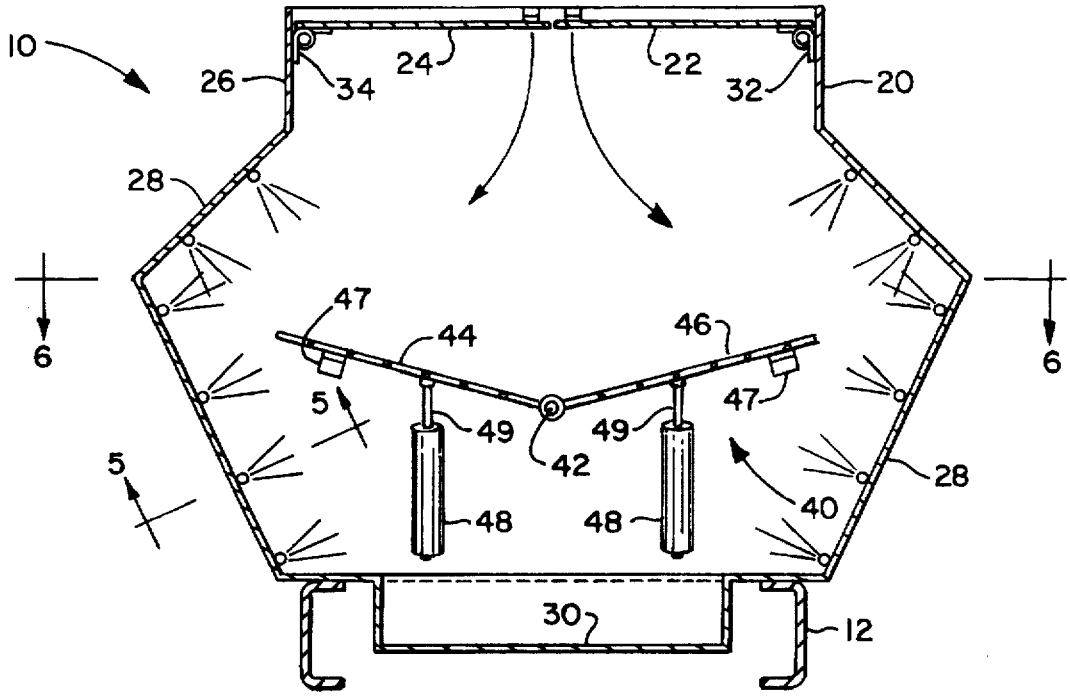
FIG. 3 is an interior end sectional view, partly in schematic, of the snow melting apparatus and vehicle of FIG. 1.
Figure 4:
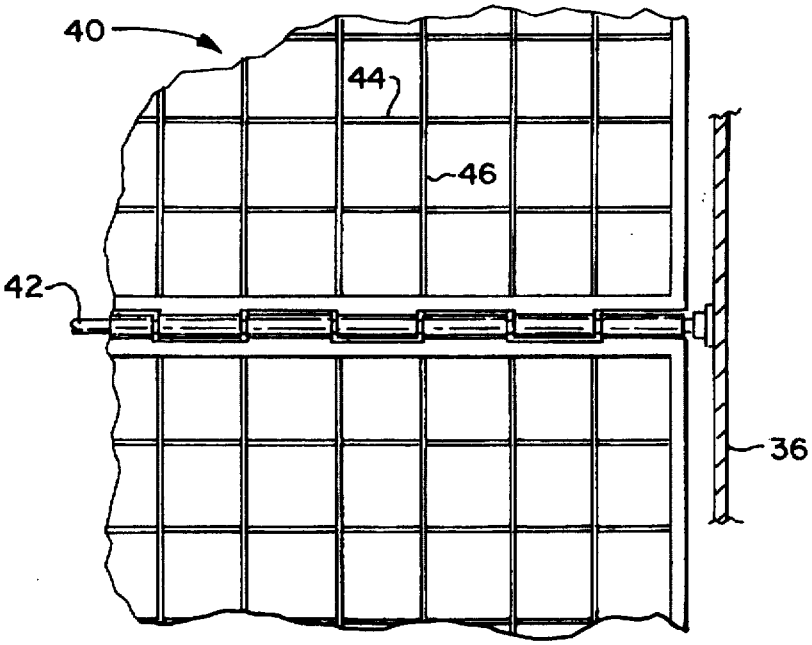
FIG. 4 is an enlarged fragmentary interior top view, partly broken away and partly in section, of the snow melting apparatus of FIG. 1.

With reference to FIGS. 3 and 4, a ram/screen subassembly 40 is interposed in the discharge path between the upper covers and the trough and extends generally the longitudinal length of the hopper enclosure. A shaft 42 extends from the forward end 36 of the hopper to the opposite rear end 38. The shaft 42 hingedly mounts a pair of pivotal screens 44 and 46. A pair of hydraulic pistons 48 disposed at the inside of the hopper drives arms 49 which independently control the position of each screen from a generally vertical to a nearly horizontal orientation defined by stops 47. The pistons may be mounted to the floor or sides of the hopper by means of brackets or other mounting structures (not illustrated). Preferably the screens pivot in tandem, but are designed to independently release if a large resistance is encountered. The screens function in two respects. First, the screens prevent large object debris from passing to the trough 30 and into the circulation path as will be described below. Second, the screens act as a ram-like lever arm to break up clumps of snow and to facilitate passage of snow material toward the trough. The debris which is retained at the upper portion of the screens may be manually removed by gaining access through the covers 22, 24 as required.

The trough 30 functions as a longitudinally extending water channel for receiving melted water. A second screen 50 may cover the top of the trough to provide a secondary barrier for retaining the snow above the trough. The openings in screen 50 are smaller than those of screens 44, 46. The forward end of the trough contains a discharge outlet 52 which provides a fitting for discharging water from the enclosure. A screen 54 is disposed across the discharge outlet. A discharge hose (not illustrated) preferably is fitted to the outlet for discharging the water into a sewer or other suitable discharge path (neither illustrated). A drain 56 is also interposed for draining all of the material from the trough at the lower rear end of the trough. The forward end of the trough communicates with a circulation conduit 60.

A furnace unit 62 is supported on the vehicle frame (or a platform) forwardly of the hopper. The furnace unit 62 may be powered by propane or gas or other fuel and includes a coil-like passage 64 which connects with the conduit 60. The coil functions as a heat exchanger with the heat produced by the furnace to melt the snow or snow slurry which traverses from the trough. A hydraulic pump 66 is preferably interposed between the furnace and the trough for pumping the liquid or slurry from the trough to the furnace. The pump 66 is powered by the hydraulic system 18 of the vehicle. Alternate pump configurations may also be employed.

A multi-level manifold 70 extends circumferentially at the inner sides of the enclosure in a multi-level ring configuration which substantially spans the side portions of the enclosure. The manifold is preferably a rigid pipe but may be a hose, plastic pipe or other configuration. Each level may have a T-shaped connector and may be internally dimensioned to balance the water pressure. A multiplicity of sprinkler heads 72 are mounted in spaced relationship along the manifold. Alternatively, the manifold may be located outside of the enclosure with the sprinklers located at the inside of the enclosure.

Figure 5:
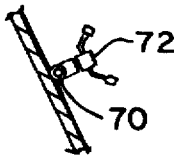
FIG. 5 is an enlarged fragmentary sectional view of the snow melting apparatus of FIG. 3 taken along the line 5—5 thereof.
Figure 6:
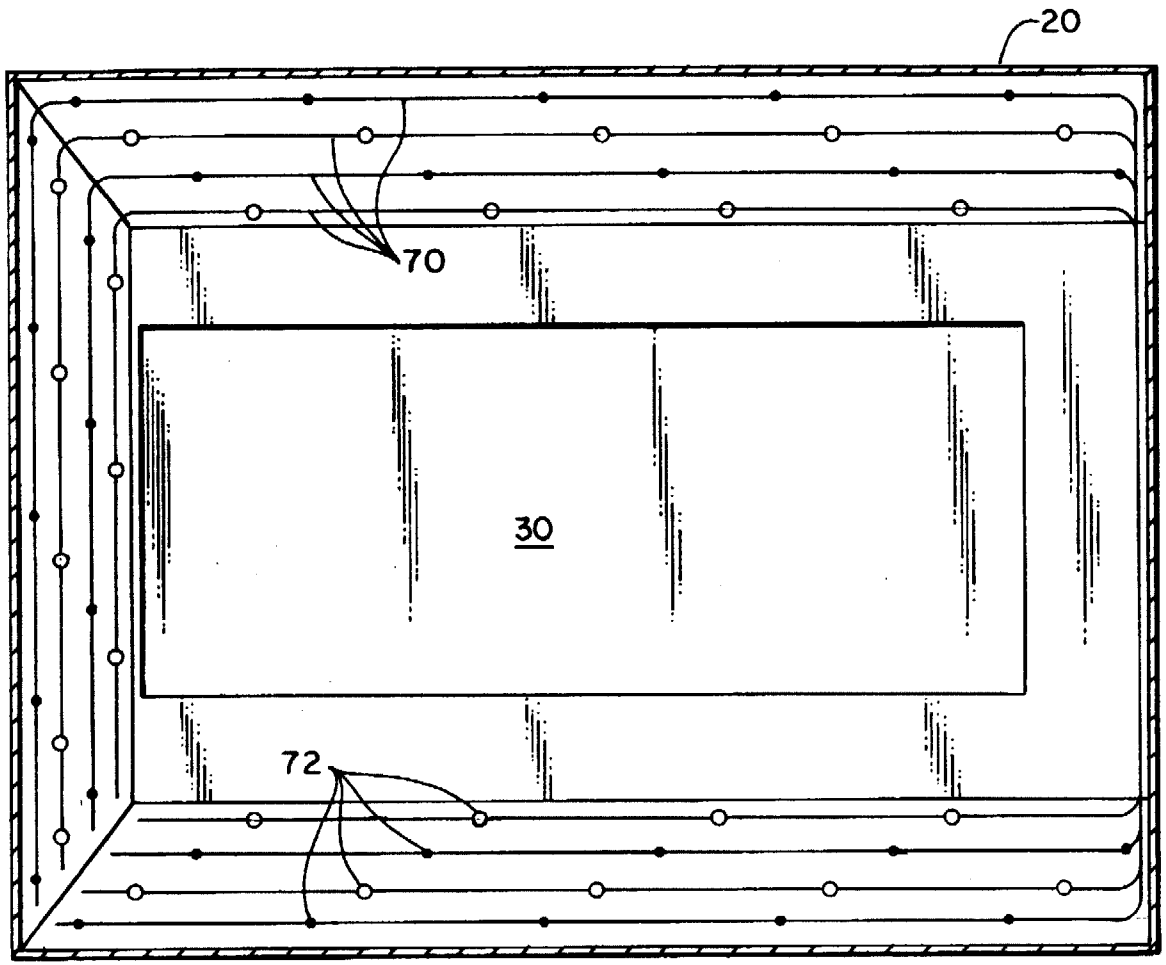
FIG. 6 is an interior sectional view, partly in schematic with portions removed, of the snow melting apparatus of FIG. 3 taken along the line 6—6 thereof.
Figure 7:
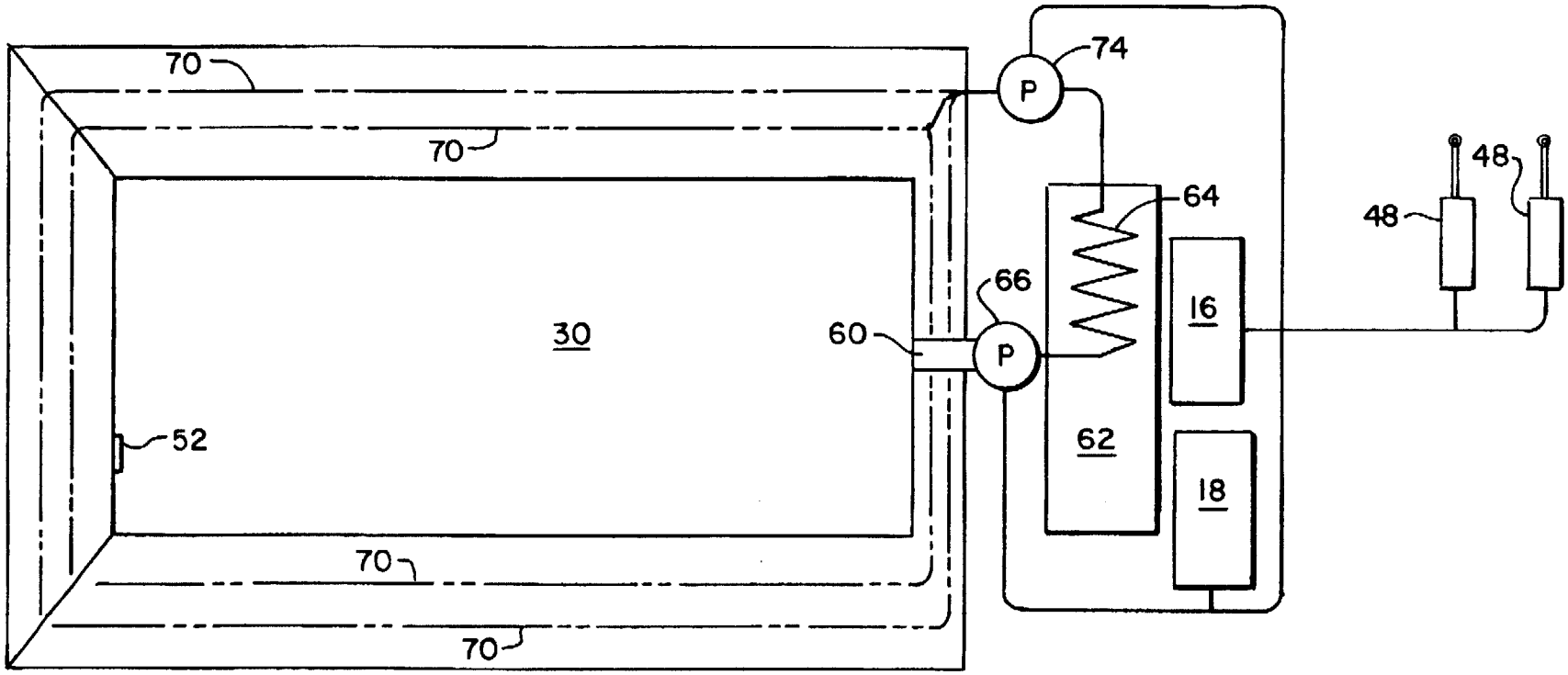
FIG. 7 is a schematic diagram of the snow melting apparatus of FIG. 1.

With reference to FIG. 5, the sprinkler heads 72 are preferably of a lawn-type configuration which rotate and provide a moving quasi-conical spray output defining a spray zone which impinges on a substantial mass of the generally centrally disposed snow debris which traverses the enclosure from the cover through the ram/screen subassembly 40 to the trough 30. The sprinkler heads 72 are preferably a single emitter-type sprinkler. The manifold 70 connects with the output conduit from the furnace. Water may be pressurized by a hydraulic pump 74 to provide a high pressure discharge through the sprinkler heads 72. A typical operating manifold pressure is approximately 40–60 psi. The melted snow initially passes to the trough for recirculation. Eventually a substantial body of water will be retained within the enclosure.

It will be appreciated that the foregoing snow melting apparatus 10 operates in an efficient manner to melt snow without the introduction of an external water supply to facilitate the snow melting process. The furnace 62 is powered to provide a heat exchanger which initiates at least some melting at the bottom portion of the snow debris which traverses from the cover through the screen toward the trough. The melted water and/or snow water slurry is pumped to the furnace wherein the mixture or water is heated and then pumped to the manifold for discharge through the sprinkler heads 72 into the unmelted snow. The spray discharge facilitates additional melting which forms a continuous circulation path through the chute to the trough. When the water level within the enclosure reaches a sufficient height, the water is then discharged through the discharge outlet 52 via a 3 or 4 inch hose into a suitable discharge basin such as a sewer system or a river or other suitable discharge path. Sediment may be removed through drain 56.

The snow melting apparatus may be efficiently mounted to the frame of a truck or other similar vehicle or inside a dump or truck body to provide a mobile snow melting capability. The power for the hydraulic pumps and the screen subassembly is preferably provided by a conventional hydraulic system for the vehicle. An alternative power source may also be provided.

While a preferred embodiment of the foregoing invention has been set forth for purposes of illustration, the foregoing description should not be deemed a limitation of the invention herein. Accordingly, various modifications, adaptations and alternatives may occur to one skilled in the art without departing from the spirit and the scope of the present invention.

What is claimed is:

1. A snow melting apparatus comprising:

hopper means defining an enclosure having opposed transversely spaced, longitudinally extending sides for receiving snow, said hopper means having a top portion which defines an inlet for snow and a lower trough and having an outlet;

circulation path means for forming a circulation path from said trough and extending generally longitudinally and transversely about said enclosure;

furnace means disposed in said circulation path means for providing a source of heat to a snow/water mixture traversing said path;

pump means for pumping said mixture through said circulation path means;

spray means comprising two transversely opposing arrays of a plurality of longitudinally spaced sprinklers located at multiple elevational positions between said top portion and said trough and communicating with said circulation path means for defining a water spray zone within the enclosure; and screen means having a lever-like configuration disposed in said enclosure between said arrays at an intermediate elevation within said spray zone for selectively preventing the passage of objects to said trough and being pivotally displaceable to break up snow which impacts said screen means, so that snow dumped in said hopper means is passable through said screen means to said trough wherein a snow/water mixture is pumped to said furnace means and heated to substantially produce water which is propelled through said spray means into snow retained in said enclosure and the melted snow is drainable through said outlet.

2. The snow melting apparatus of claim 1 wherein said circulation path means comprises a multi-level manifold.

3. The snow melting apparatus of claim 1 wherein said furnace means further comprises a coil-like conduit in heat exchange relationship with said heat generated by said furnace means.

4. The snow melting apparatus of claim 1 wherein said pump means further comprises a pump which is operable by a hydraulic system of an associated vehicle.

5. The snow melting apparatus of claim 1 wherein said sprinklers each have an opening defining an axis extending therethrough and comprise heads rotatable about said axis.

6. The snow melting apparatus of claim 1 wherein said screen means further comprises a pair of screen members which are pivotable about a generally longitudinal axis through said enclosure.

7. The snow melting apparatus of claim 6 wherein said screen means is displaceable by power supplied by a hydraulic system.

8. The snow melting apparatus of claim 1 wherein said hopper means further comprises a cover.

9. The snow melting apparatus of claim 8 wherein said cover comprises a pair of panels which are spring biased to a closed position and which are displaceable to receive snow debris which is dumped on top of said panels.

10. The snow melting apparatus of claim 1 further comprising a screen member disposed above said trough and below said screen means.

11. A snow melting apparatus comprising:

hopper means defining an enclosure having opposed transversely spaced, longitudinally extending sides for receiving snow, said hopper means having a cover which is displaceable to define an inlet for snow and having a lower trough;

circulation path means for forming a circulation path from said trough and generally extending about said enclosure;

furnace means disposed in said circulation path means for providing a source of heat to a snow/water mixture traversing said path;

pump means for pumping said mixture through said circulation path means;

spray means comprising two transversely opposing arrays of a plurality of longitudinally spaced sprinklers each located at an elevational position between said top portion and said trough and communicating with said circulation path means for defining a water spray zone within the enclosure;

screen means having a lever-like configuration disposed in said enclosure between said arrays at an intermediate elevation within said spray zone for selectively preventing the passage of objects to said trough and being pivotally displaceable to break up snow which impacts said screen means, so that snow dumped in said hopper means is passable through said screen means to said trough wherein a snow/water mixture is pumped to said furnace means and heated to substantially produce water which is propelled through said spray means into snow retained in said enclosure.

12. The snow melting apparatus of claim 11 wherein said circulation path means comprises a multi-level manifold which spans around the interior of said enclosure in a quasi-ring-like configuration.

13. The snow melting apparatus of claim 12 wherein said manifold comprises elongated conduits disposed in opposing parallel relationship and further comprising a multiplicity of longitudinally spaced sprinkler heads communicating with said conduits.

14. The snow melting apparatus of claim 12 wherein said cover comprises a pair of panels which are spring biased to a closed position and which are displaceable to receive snow debris which is dumped on top of said covers.

15. The snow melting apparatus of claim 11 wherein said spray means comprises rotatable sprinkler heads.

16. The snow melting apparatus of claim 11 wherein said screen means further comprises a pair of screen members which are pivotable about a generally longitudinal shaft which is disposed in said enclosure.

17. The snow melting apparatus of claim 16 wherein said screen means is displaceable by power supplied by a hydraulic system.

18. A snow melting apparatus comprising:

hopper means defining an enclosure having opposed transversely spaced. longitudinally extending sides for receiving snow, said hopper means having a top portion which defines an inlet for snow, a lower trough and an outlet;

circulation path means for forming a circulation path from said trough and extending generally around said enclosure at the interior thereof;

furnace means disposed in said circulation path means for providing a source of heat to a snow/water mixture traversing said path;

spray means comprising two transversely opposing arrays of a plurality of longitudinally spaced sprinklers each located at an elevational position between said top portion and said trough and communicating with said circulation path means for defining a water spray zone within the enclosure;

screen means comprising a pair of screen sections disposed in said enclosure for selectively preventing the passage of objects to said trough, each said section being independently pivotally displaceable about an axis to form a lever-like ram, so that snow dumped in said hopper means is passable through said screen means to said trough wherein a snow/water mixture is transferable to said furnace means and heated to substantially produce water which is propelled through said spray means into snow retained in said enclosure and the melted snow is drainable through said outlet.

19. The snow melting apparatus of claim 18 wherein said circulation path means comprises a multi-level manifold.

20. The snow melting apparatus of claim 18 wherein said sprinklers each have an opening defining an axis extending therethrough and comprise heads rotatable about said axis.

* * * * *